US007588017B2

(12) United States Patent
Briggs et al.

(10) Patent No.: US 7,588,017 B2
(45) Date of Patent: Sep. 15, 2009

(54) LOW PRESSURE JET BY-PASS SYSTEM FOR FUEL PUMP

(75) Inventors: Paul F. Briggs, Grand Blanc, MI (US); Matthias Nederegger, Rochester Hills, MI (US)

(73) Assignee: Continental Automotive Systems US, Inc., Auburn Hills, MI (US)

( * ) Notice: Subject to any disclaimer, the term of this patent is extended or adjusted under 35 U.S.C. 154(b) by 0 days.

(21) Appl. No.: 12/010,250

(22) Filed: Jan. 23, 2008

(65) Prior Publication Data

US 2008/0173282 A1 Jul. 24, 2008

Related U.S. Application Data

(60) Provisional application No. 60/897,133, filed on Jan. 24, 2007.

(51) Int. Cl.
*F02M 37/04* (2006.01)
*F02M 37/10* (2006.01)

(52) U.S. Cl. ..... 123/509

(58) Field of Classification Search ..... 123/509, 123/506, 497, 514, 510, 511; 137/115.01, 137/115.03, 115.06, 115.13
See application file for complete search history.

(56) References Cited

U.S. PATENT DOCUMENTS 6,109,299 A * 8/2000 Hashimoto et al. ..... 137/574
6,341,623 B1 * 1/2002 Channing ..... 137/565.22
6,425,378 B1 * 7/2002 Frank ..... 123/514
6,513,503 B2 * 2/2003 Iwamoto et al. ..... 123/509
6,868,836 B2 * 3/2005 Buehler et al. ..... 123/509
7,069,913 B1 7/2006 Crary
7,117,854 B2 * 10/2006 Schmitt ..... 123/509
7,191,767 B2 * 3/2007 Schmitt ..... 123/509

FOREIGN PATENT DOCUMENTS

DE 10246694 A1 4/2004
DE 102004052439 A1 5/2006
EP 0771946 A 5/1997
WO WO 03/016084 A 2/2003

* cited by examiner

*Primary Examiner*—Mahmoud Gimie

(57) ABSTRACT

By-pass structure (45) is connected between a high pressure portion of a fuel pump (16) and an inlet of a jet nozzle (24) of a jet assembly (18) of a fuel delivery module (10) of a vehicle. The by-pass structure is constructed and arranged such that under certain conditions when the flow of fuel from the low pressure portion of the fuel pump alone is insufficient to operate the jet pump assembly, fuel is selectively permitted to flow through the by-pass structure from the high pressure portion of the fuel pump to the inlet of the jet nozzle ensuring that a sufficient flow of fuel is present at the jet assembly to draw fuel into the reservoir.

20 Claims, 2 Drawing Sheets

LOW PRESSURE JET BY-PASS SYSTEM FOR FUEL PUMP

This application claims the benefit of the earlier filing date of U.S. Provisional Application No. 60/897,133, filed on Jan. 24, 2007, which is hereby incorporated by reference into this specification.

FIELD OF THE INVENTION

The invention relates to fuel delivery module for automobile vehicles and, more particularly, to operation of a jet assembly associated with a fuel pump of the module.

BACKGROUND OF THE INVENTION

A fuel delivery module is a device inside a fuel tank that allows a vehicle to perform under conditions of low fuel remaining in the fuel tank. The module includes a reservoir that is kept continuously full by, for example, a jet assembly, even when the remainder of the tank is nearly empty. A fuel pump of the module creates pressure conditions at a low pressure side of the pump to operate the jet assembly. A high pressure side of the fuel pump delivers fuel from the reservoir to an engine.

In an electronically pressure controlled fuel system such as an Electronic Returnless Fuel System (ERFS), the pump is supplied a voltage that is pulse width modified (PWM) to control the speed of the pump (this in effect lowers the voltage to the pump as the pump integrates the voltage PWM to a level). When the fuel pump operates at low RPM (e.g., due to low voltage in the range of about 3.5V to 6 V), the pressure at the low pressure side of the fuel pump is low, which is not sufficient to operate the jet assembly.

There is a need to ensure that the jet assembly of a fuel delivery module operates when the pressure at the low pressure side of the fuel pump is insufficient to operate the jet assembly.

SUMMARY OF THE INVENTION

An object of the invention is to fulfill the need referred to above. In accordance with the principles of the present invention, this objective is obtained by providing a fuel delivery module for a vehicle including a reservoir constructed and arranged to be mounted in a fuel tank of a vehicle. The reservoir has an opening therein permitting fuel to enter the reservoir. A fuel pump is provided in the reservoir. The fuel pump includes a high pressure portion and a low pressure portion. The fuel pump is constructed and arranged to draw fuel from the reservoir and send fuel from the high pressure portion to an engine of a vehicle. A jet assembly includes a jet nozzle having an inlet fluidly connected with the low pressure portion of the fuel pump and a venturi tube associated with the jet nozzle. The jet assembly is associated with the opening in the reservoir and constructed and arranged so that when a sufficient fuel flow from the low pressure portion of the fuel pump is sent through the jet nozzle and venture tube, fuel is drawn into the reservoir through the opening. By-pass structure is connected between the high pressure portion of the fuel pump and the inlet of the jet nozzle. The by-pass structure is constructed and arranged such that under certain conditions when the flow of fuel from the low pressure portion of the fuel pump alone is insufficient to operate the jet pump assembly, fuel is selectively permitted to flow through the by-pass structure from the high pressure portion of the fuel pump to the inlet of the jet nozzle ensuring that a sufficient flow of fuel is present at the jet assembly to draw fuel into the reservoir.

In accordance with another aspect of the invention, a method is provided for ensuring that a jet pump assembly is supplied with a sufficient amount of fuel to operate. The method provides a fuel reservoir having an opening therein. A fuel pump is provided in the reservoir. The fuel pump includes a high pressure portion and a low pressure portion. The fuel pump is constructed and arranged to draw fuel from the reservoir and to send fuel from the high pressure portion to an engine of a vehicle. A jet pump assembly has a jet nozzle having an inlet fluidly connected with the low pressure portion of the fuel pump and a venturi tube associated with the jet nozzle. The jet assembly is associated with the opening in the reservoir and is constructed and arranged so that when a sufficient fuel flow from the low pressure portion of the fuel pump is sent through the jet nozzle and venture tube, fuel is drawn into the reservoir through the opening. Under certain conditions when the flow of fuel from the low pressure portion of the fuel pump alone is insufficient to operate the jet pump assembly, the method includes directing fuel from the high pressure portion of the fuel pump to the inlet of the jet nozzle ensuring that a sufficient flow of fuel is present at the jet assembly to draw fuel into the reservoir.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWINGS

The invention will be better understood from the following detailed description of the preferred embodiments thereof, taken in conjunction with the accompanying drawings, wherein like reference numerals refer to like parts, in which.

DETAILED DESCRIPTION OF THE EXEMPLARY EMBODIMENT

Figure 1:
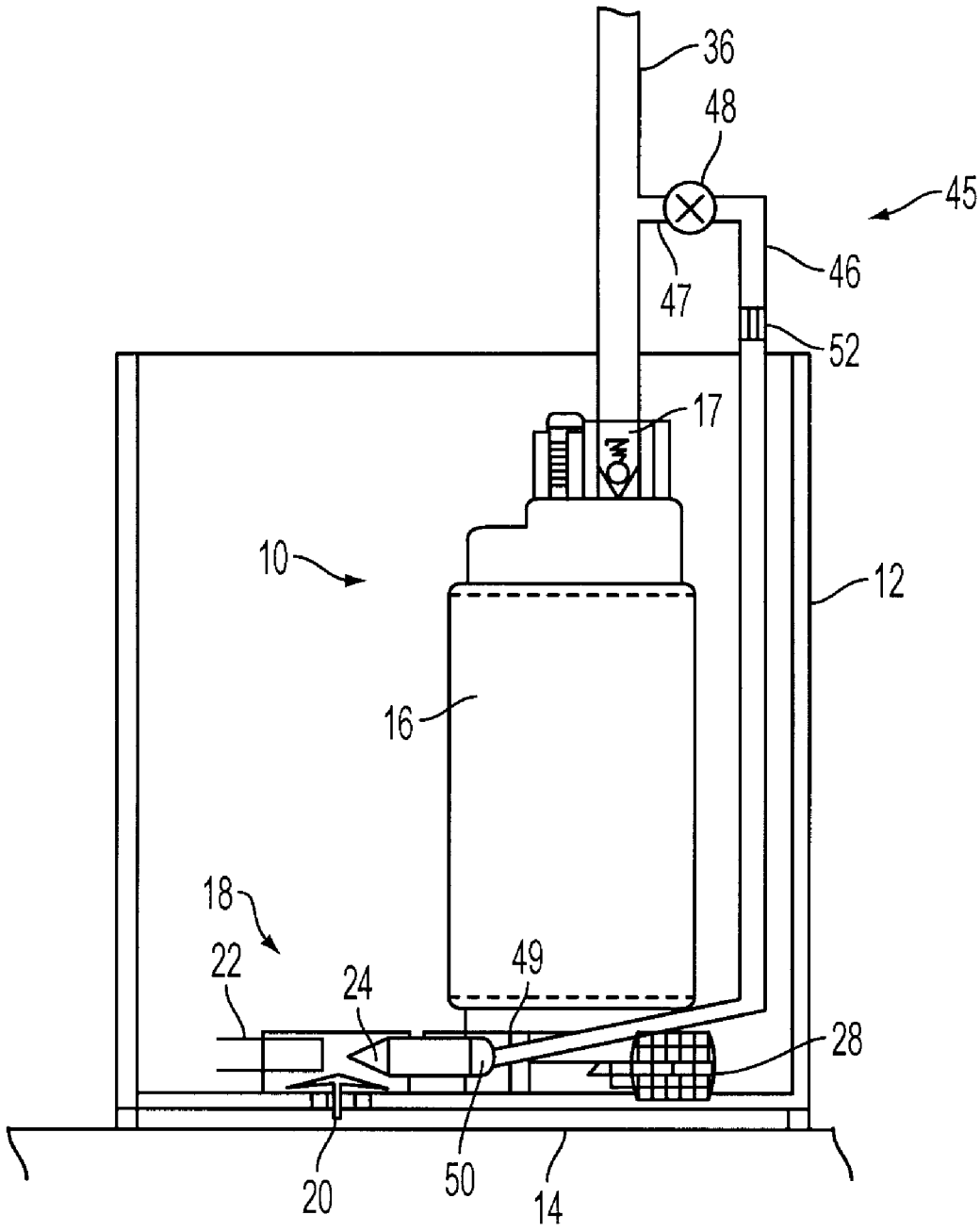
FIG. 1 is a view of a fuel delivery module including a by-pass line in accordance with an embodiment of the invention.

With reference to FIG. 1, a fuel delivery system for delivering fuel to an engine of a vehicle is shown, generally indicated at 10, in accordance with the principles of the present invention. The system 10 includes a reservoir 12 that is disposed in a vehicle's fuel tank 14. A conventional fuel pump 16 is provided in the reservoir 12 for pumping fuel from the reservoir to the engine (not shown) of the vehicle via line 36. A flow check valve 17 is provided in line 36. The fuel pump 16 also operates a jet assembly 18 that draws fuel from the tank 14 into the reservoir 12 to ensure that the reservoir 12 is replenished with fuel. The jet assembly 18 includes a venturi tube 22 associated with a jet nozzle 24 in the conventional manner to draw fuel past a jet valve 20 into the reservoir 12.

Figure 2:
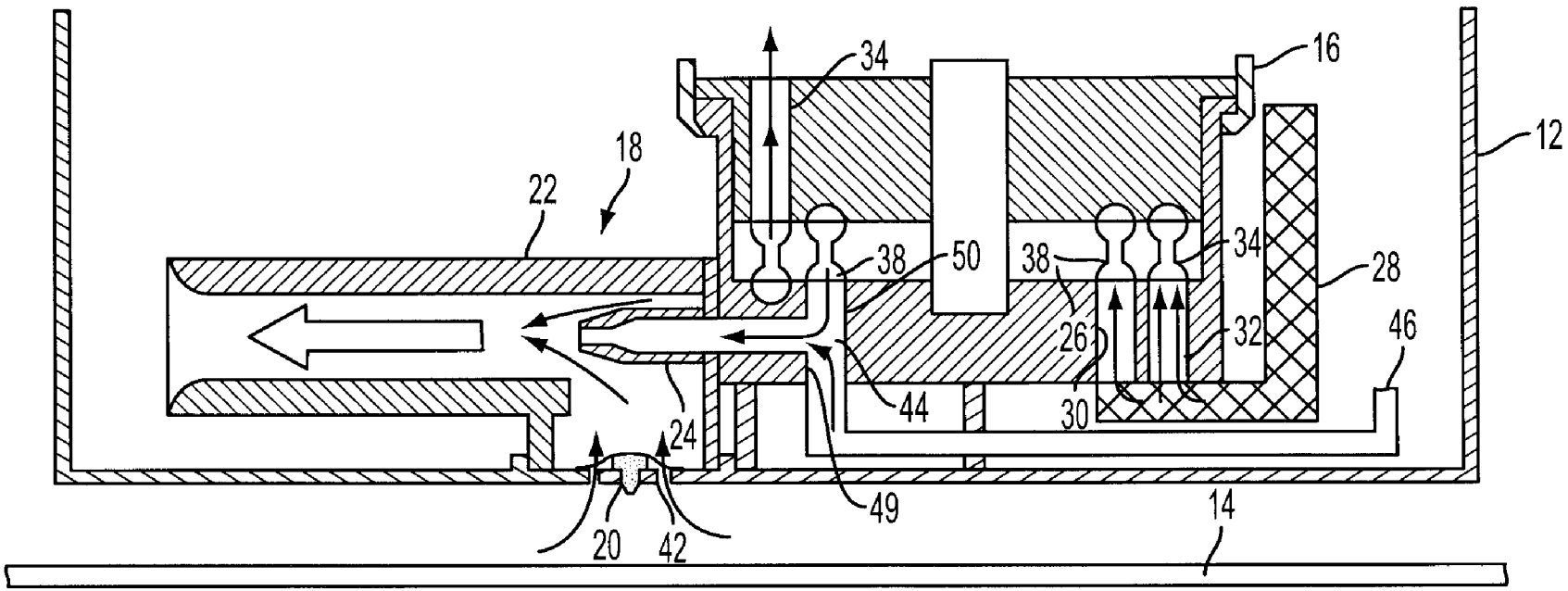
FIG. 2 is a partial sectional view of the fuel delivery module of FIG. 1.

More particularly, with reference to FIG. 2, as an impeller 26 of the fuel pump 16 rotates, fuel is drawn from the reservoir 12, through a filter 28 and through pump inlets 30 and 32. High pressure fuel is delivered from a high pressure portion 34 of the fuel pump 16 to the engine via outlet line 36. A low pressure portion 38 of the fuel pump 16 sends fuel through the jet nozzle 24, associated with tube 22, to draw fuel past valve 20, associated with opening 42 in the bottom of the reservoir 12, to replenish fuel in the reservoir 12.

As noted above, when the fuel pump (e.g. impeller 26) operates at low RPM with the pump pressure in portion 38 of about 100-300 KPa, there is insufficient fuel flow through the jet nozzle 24 to draw fuel into the reservoir 12. Thus, in accordance with an embodiment of the invention, by-pass structure, generally indicated at 45, is provided to by-pass fuel from the high pressure portion 34 of the fuel pump 16 and direct it to the inlet 44 of the jet nozzle 24 to drive the jet assembly 18 with a flow increased from the flow the jet assembly 18 would receive from the low pressure portion 38 alone. In particular, with reference to FIGS. 1 and 2, the by-pass structure 45 includes a by-pass line 46 connected between the high pressure portion 34 and the inlet 44 of the jet nozzle 24. In particular, an end 47 of the by-pass line 46 is coupled with outlet line 36 and the other end 49 of the by-pass line 46 is coupled with a fitting 50 associated with the inlet 44 of the jet nozzle 24.

The by-pass structure 45 also includes a valve 48 (FIG. 1) preferably provided in line 46. The valve 48 is pressure operated so as to open at a certain low pressure to support priming of the jet nozzle 24 and closes above a certain, higher pressure as the pressure inside the jet main feeding channel is sufficient to operate the jet assembly 18. Thus, when the valve 48 is opened, fuel in outlet line 36 flows through the by-pass line 46 to the inlet 44 of the jet nozzle 24 to increase fuel flow through the jet nozzle 24. This fuel flow ensures that the jet assembly 18 will draw fuel into the reservoir 12 even though fuel flow from the low pressure portion 38 of the fuel pump alone is insufficient to operate the jet assembly 18 to replenish fuel in the reservoir 12. The arrows in FIG. 2 indicate fuel flow directions. To control the amount of fuel that flows through the bypass line 46 to the inlet of the jet nozzle 24 and to reduce high pressure loss, an orifice 52 can be provided in the bypass line 46 or can be associated with the valve 48.

In the embodiment, the fitting 50 is a T-connection provided in the jet or pump housing to join the flow from the bypass line 46 with the flow from the low pressure portion 38 of the fuel pump 16 at the inlet 44 of the jet nozzle 24.

The valve 48 can be incorporated into a primary portion of the fuel pump 16 or in an existing by-pass port on the pump 16 that is typically used to drive a remote fuel pick-up jet system (not shown). The valve 48 can be a two valve for jet priming only or a three way valve to permit jet priming and high pressure flow.

Although a dual channel fuel pump is shown, it can be appreciated that the bypass line 46 can be employed with any type of fuel pump that uses a jet assembly. Thus, whenever pressure to the fuel rail exceeds the feeding pressure of the jet assembly, at least a portion of the higher pressure can be diverted and used to support the jet assembly.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. A fuel delivery module for a vehicle comprising:

a reservoir constructed and arranged to be mounted in a fuel tank of a vehicle, the reservoir having an opening in a bottom thereof permitting fuel to enter the reservoir, a fuel pump in the reservoir, the fuel pump including a high pressure portion and a low pressure portion, the fuel pump being constructed and arranged to draw fuel from the reservoir and send fuel from the high pressure portion to an engine of a vehicle, a jet assembly including a jet nozzle having an inlet fluidly connected with the low pressure portion of the fuel pump, and a venturi tube associated with the jet nozzle, the jet assembly being associated with the opening in the reservoir and constructed and arranged so that when a sufficient fuel flow from the low pressure portion of the fuel pump is sent through the jet nozzle and venture tube, fuel is drawn into the reservoir through the opening, and by-pass structure connected between the high pressure portion of the fuel pump and the inlet of the jet nozzle, the by-pass structure being constructed and arranged such that under certain conditions when the flow of fuel from the low pressure portion of the fuel pump alone is insufficient to operate the jet pump assembly, fuel is selectively permitted to flow through the by-pass structure from the high pressure portion of the fuel pump to the inlet of the jet nozzle ensuring that a sufficient flow of fuel is present at the jet assembly to draw fuel into the reservoir.

2. The module of claim 1, wherein the by-pass structure comprises a by-pass line and a valve associated with the by-pass line to permit the fuel flow under certain pressure conditions and to prevent the fuel flow under pressure conditions different from the certain pressure conditions.

3. The module of claim 2, wherein the valve is one of a two-way or three-way valve.

4. The module of claim 2, wherein the high pressure portion of the fuel pump is fluidly connected with an outlet line of the pump, one end of the by-pass line being coupled with the outlet line and the valve being disposed in the by-pass line.

5. The module of claim 4, wherein another end of the by-pass line is coupled with a fitting associated with the inlet of the jet nozzle.

6. The module of claim 5, wherein the fitting is a T-connection such that the inlet of the jet nozzle communicates with the by-pass line and with the low pressure portion of the fuel pump.

7. The module of claim 2, further comprising an orifice associated with the bypass line to control fuel flow to the inlet of the jet nozzle.

8. A fuel delivery module for a vehicle comprising:

a reservoir constructed and arranged to be mounted in a fuel tank of a vehicle, the reservoir having an opening in a bottom thereof permitting fuel to enter the reservoir, means, in the reservoir, for pumping fuel, the means for pumping including a high pressure portion and a low pressure portion and being constructed and arranged to draw fuel from the reservoir and send fuel from the high pressure portion to an engine of a vehicle, means for replenishing fuel in the reservoir, the means for replenishing having an inlet fluidly connected with the low pressure portion of the means for pumping and being associated with the opening in the reservoir and constructed and arranged so that when a sufficient fuel flow from the low pressure portion of the means for pumping is sent through the means for replenishing, fuel is drawn into the reservoir through the opening, and means for by-passing connected between the high pressure portion of the means for pumping and the inlet of the means for replenishing, the means for by-passing ensuring that under certain conditions when the flow of fuel from the low pressure portion of the means for pumping alone is insufficient to operate the means for replenishing, fuel is selectively permitted to flow from the high pressure portion to the inlet so that that a sufficient flow of fuel is present at the means for replenishing to draw fuel into the reservoir.

9. The module of claim 8, wherein the means for by-passing comprises a by-pass line and a valve associated with the by-pass line to permit under the fuel flow under certain pressure conditions and to prevent the fuel flow under pressure conditions different from the certain pressure conditions.

10. The module of claim 9, wherein the valve is one of a two-way or three-way valve.

11. The module of claim 9, wherein the high pressure portion is fluidly connected with an outlet line of the means for pumping, one end of the by-pass line being coupled with the outlet line and the valve being disposed in the by-pass line.

12. The module of claim 11, wherein the means for replenishing is a jet assembly having a jet nozzle and an associated venturi tube, the inlet being an inlet of the jet nozzle and wherein another end of the by-pass line is coupled with a fitting associated with the inlet of the jet nozzle.

13. The module of claim 12, wherein the fitting is a T-connection such that the inlet of the jet nozzle communicates with the by-pass line and with the low pressure portion.

14. The module of claim 8, wherein the means for pumping is a fuel pump.

15. The module of claim 9, further comprising an orifice associated with the bypass line to control fuel flow to the inlet.

16. A method of ensuring that a jet pump assembly is supplied with a sufficient amount of fuel to operate, the method comprising:

providing a fuel reservoir having an opening in a bottom thereof, providing a fuel pump in the reservoir, the fuel pump including a high pressure portion and a low pressure portion, the fuel pump being constructed and arranged to draw fuel from the reservoir and to send fuel from the high pressure portion to an engine of a vehicle, providing a jet pump assembly having a jet nozzle having an inlet fluidly connected with the low pressure portion of the fuel pump, and a venturi tube associated with the jet nozzle, the jet assembly being associated with the opening in the reservoir and is constructed and arranged so that when a sufficient fuel flow from the low pressure portion of the fuel pump is sent through the jet nozzle and venture tube, fuel is drawn into the reservoir through the opening, and under certain conditions when the flow of fuel from the low pressure portion of the fuel pump alone is insufficient to operate the jet pump assembly, directing fuel from the high pressure portion of the fuel pump to the inlet of the jet nozzle ensuring that a sufficient flow of fuel is present at the jet assembly to draw fuel into the reservoir.

17. The method of claim 16, wherein the directing step provides a by-pass line between the high pressure portion of the fuel pump and the inlet of the jet nozzle, with a valve associated with the by-pass line to permit fuel flow under certain pressure conditions and to prevent the fuel flow under pressure conditions different from the certain pressure conditions.

18. The method of claim 17, wherein the high pressure portion of the fuel pump is fluidly connected with an outlet line of the pump, one end of the by-pass line being coupled with the outlet line and the valve being disposed in the by-pass line.

19. The method of claim 18, wherein another end of the by-pass line is coupled with a fitting associated with the inlet of the jet nozzle.

20. The method of claim 19, wherein the fitting is a T-connection such that the inlet of the jet nozzle communicates with the by-pass line and with the low pressure portion of the fuel pump.

* * * * *